US005323218A

United States Patent [19]

Forbes, II et al.

[11] Patent Number: 5,323,218

[45] Date of Patent: Jun. 21, 1994

[54] PASSIVE SUMP FILL BAFFLE FOR BLADE CLEANING APPARATUS

[75] Inventors: Richard L. Forbes, II, Pittsford; Bruce E. Thorp, Walworth, both of N.Y.

[73] Assignee: Xerox Corporation, Stamford, Conn.

[21] Appl. No.: 906,164

[22] Filed: Jun. 29, 1992

[51] Int. Cl.[5] ..... G03G 21/00

[52] U.S. Cl. ..... 355/298; 15/256.5; 355/299; 430/125

[58] Field of Search ..... 355/296, 298, 299; 118/652; 15/256.5, 256.51, 256.52; 430/125

[56] References Cited

U.S. PATENT DOCUMENTS

| | | | |
|---|---|---|---|
| 3,917,397 | 11/1975 | Tanaka et al. | 355/298 X |
| 4,043,298 | 8/1977 | Swackhamer | 118/652 |
| 4,530,594 | 7/1985 | Adachi | 15/256.52 |
| 4,681,426 | 7/1987 | Bean et al. | 355/298 |
| 4,685,798 | 8/1987 | Matsumoto | 15/256.5 X |
| 4,690,544 | 9/1987 | Forbes, II et al. | 355/299 |
| 5,031,001 | 7/1991 | Kusumoto | 355/298 |
| 5,107,305 | 4/1992 | Charland et al. | 355/298 |

FOREIGN PATENT DOCUMENTS

| | | | |
|---|---|---|---|
| 0277877 | 11/1989 | Japan | 355/298 |
| 0210382 | 8/1990 | Japan | 355/298 |
| 0298982 | 12/1990 | Japan | 355/298 |

*Primary Examiner*—Lincoln Donovan
*Assistant Examiner*—Christopher Horgan

[57] ABSTRACT

Electrostatographic printing apparatus comprising an endless imaging surface and a blade cleaning station for removing residual toner particles therefrom, the blade cleaning station being positioned on top of the imaging surface at about the twelve o'clock position and includes a cleaner sump housing containing a cleaning blade mounted on the sump to provide front and rear sump portions and in interference with the imaging surface for removing residual toner therefrom, the cleaner sump housing having a passive sump fill baffle mounted thereon to direct residual toner to the front and rear portions of the cleaner sump, the passive sump fill baffle being positioned above and relative to said cleaning blade to split a mass of accumulated residual toner, limit the toner head height and direct residual cleaned toner to both the front and rear sump portions.

15 Claims, 5 Drawing Sheets

PASSIVE SUMP FILL BAFFLE FOR BLADE CLEANING APPARATUS

CROSS REFERENCE TO RELATED APPLICATIONS

Reference is hereby made to copending application Ser. No. 07/906,171 entitled Active Sump Fill Device For Blade Cleaning Apparatus, in our names filed concurrently herewith.

BACKGROUND OF THE INVENTION

The present invention relates to electrostatographic printing apparatus and more particularly to blade cleaning apparatus for use in such a printing system.

U.S. Pat. Nos. 4,690,544 and 4,681,426 describe and illustrate an electrostatographic printing machine with a removable imaging cartridge which has a belt type imaging surface or photoreceptor with a cleaner housing to remove residual toner material at about the twelve o'clock position on top of the belt. This geometry generally provides satisfactory cleaning and is used in the Xerox 5028 family of products. However, with an increasing desire for further cartridge life, additional cleaning capacity in the cleaner housing is required. In an extended life situation cleaning failure usually takes place according to two modes. Fine line cleaning failures are usually caused by debris such as paper fibers or other small particulate matter that become trapped under the cleaning blade which allows toner to pass under the blade ending up as a streak on the final print. Nicks or tears in the blade also cause fine line failures, but at much lower rate. Broadband cleaning failures occur due to an overfilled condition in the cleaning sump. During cleaning the area in front of the blade tip becomes filled with toner which is constantly in motion and gradually builds up on top of the blade (in a volcano-like fashion) compressing itself upon itself and producing a packing density of toner higher than the normal density of toner. In addition, the cleaning action generates heat and since the cleaner is in relatively close proximity to the heated fuser and precharge erase exposure lamp, the combination of compression due to cleaning force and heat promotes toner agglomeration so that the toner does not readily flow away from the cleaning blade. Ultimately as new toner comes in and tries to move up the face of the cleaning blade and away from the photoreceptor, the blade/imaging surface interface experiences forces reflected down from the toner mass buildup above the blade that changes both the blade tip geometry with respect to the imaging surface and the actual blade force on the imaging surface. As a result, the blade begins to plane on the toner on the imaging surface and the toner passes under the blade which has been lifted off the imaging surface. This begins as a grey patch that comes and goes, but eventually is continuous and gives a wide deposit of toner on the final print.

SUMMARY OF THE INVENTION

In a principle aspect of the present invention a passive sump fill baffle for a blade cleaning apparatus is provided which diverts residual cleaned toner which has been cleaned from an imaging surface by a blade cleaning system and stored in a cleaner sump at about the twelve o'clock position with respect to the imaging surface to maximize available sump space and delay the onset of broadband cleaning failure.

In a further aspect of the present invention the passive sump fill baffle is mounted in the cleaner sump to direct residual toner to the front and rear portions of the cleaner sump and is positioned above and relative to the cleaning blade to split the mass of accumulated residual toner, limit head height of toner accumulated at the cleaning blade/imaging surface interface and direct residual cleaned toner to both the front and rear sump portions.

In a further aspect of the present invention the passive sump fill baffle is concavely curved in a downstream direction of the imaging surface.

In a further aspect of the present invention the passive sump fill baffle is integrally molded with the molded plastic cleaner housing. Baffles do not need to be molded as integral part of cleaner housing. They can be a separate drop in piece of same or different material.

In a further aspect of the present invention the imaging surface is an endless flexible belt supported for movement between two support members defining a substantially horizontal top run therebetween and including a rigid stationary cleaning platen under the top run of the belt, between the support members for supporting the belt and the cleaning blade is mounted in opposed relationship to the platen.

In a further aspect of the present invention a flexible flap seal is mounted to the cleaner sump housing upstream of the cleaning blade in the process direction.

In a further aspect of the present invention the cleaning blade is in chiseling contact with the imaging surface for removing toner therefrom.

In a further aspect of the present invention the sump fill baffle has a toner directing lead end which is located above the imaging surface between the cleaning tip of the cleaning blade and the sealing edge of the flap seal.

DESCRIPTION OF A PREFERRED EMBODIMENT

According to the present invention the passive sump fill baffle is provided in a cleaner housing located on top of or about the twelve o'clock position with respect to the imaging surface which is intended to limit the head height of the toner directly above the tip of the cleaning blade by directing the toner to front and rear portions of the cleaner sump housing. The passive sump fill baffle takes advantage of the kinetic energy of the toner itself, as the toner has a directional force coming from the motion of the imaging surface and the cleaning action of the blade mounted in interference with the imaging surface which tends to drive the toner upwardly. The baffle is in position to split the mass of toner to limit the head height that is accumulated and may be partially agglomerated at the blade/photoreceptor interface and to direct the toner away from the blade tip to the front and rear sump portions. The passive sump fill baffle enables an increased quantity of toner to be directed away from the top of the cleaner blade and be accumulated in the sump housing.

Figure 1:
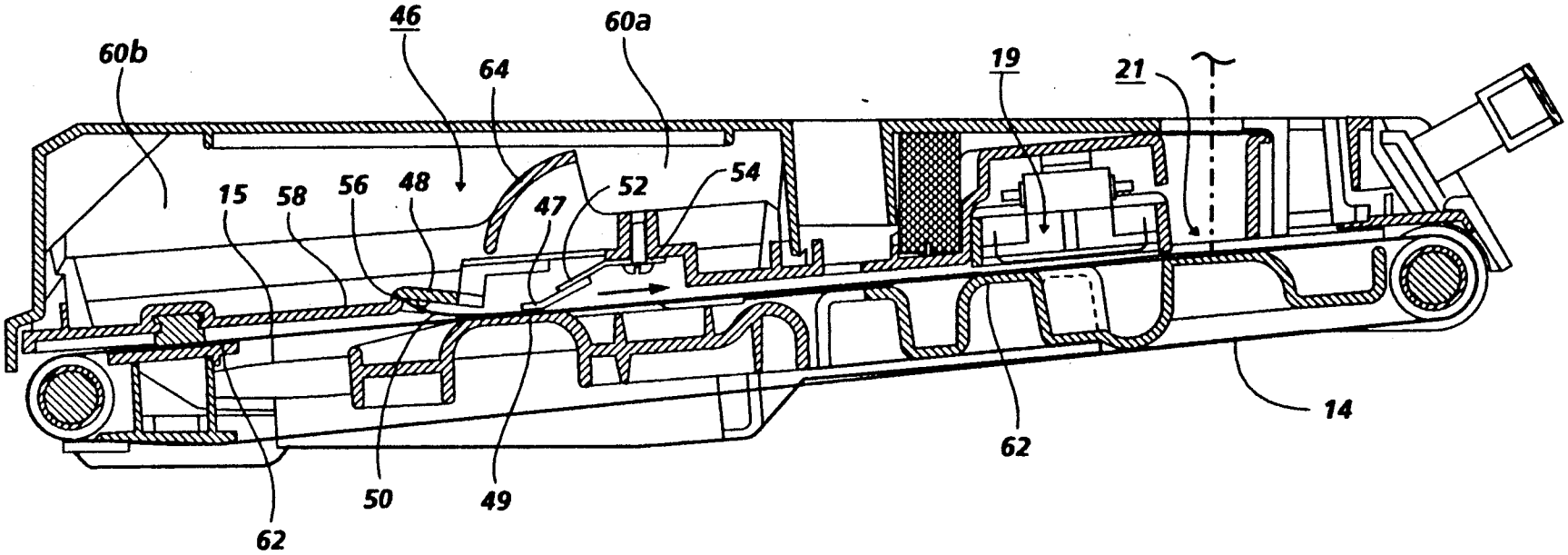
FIG. 1 is a cross sectional view of a removable and replaceable cartridge employing the blade cleaning station, and in particular, the passive sump fill baffle, according to the present invention.
Figure 2:
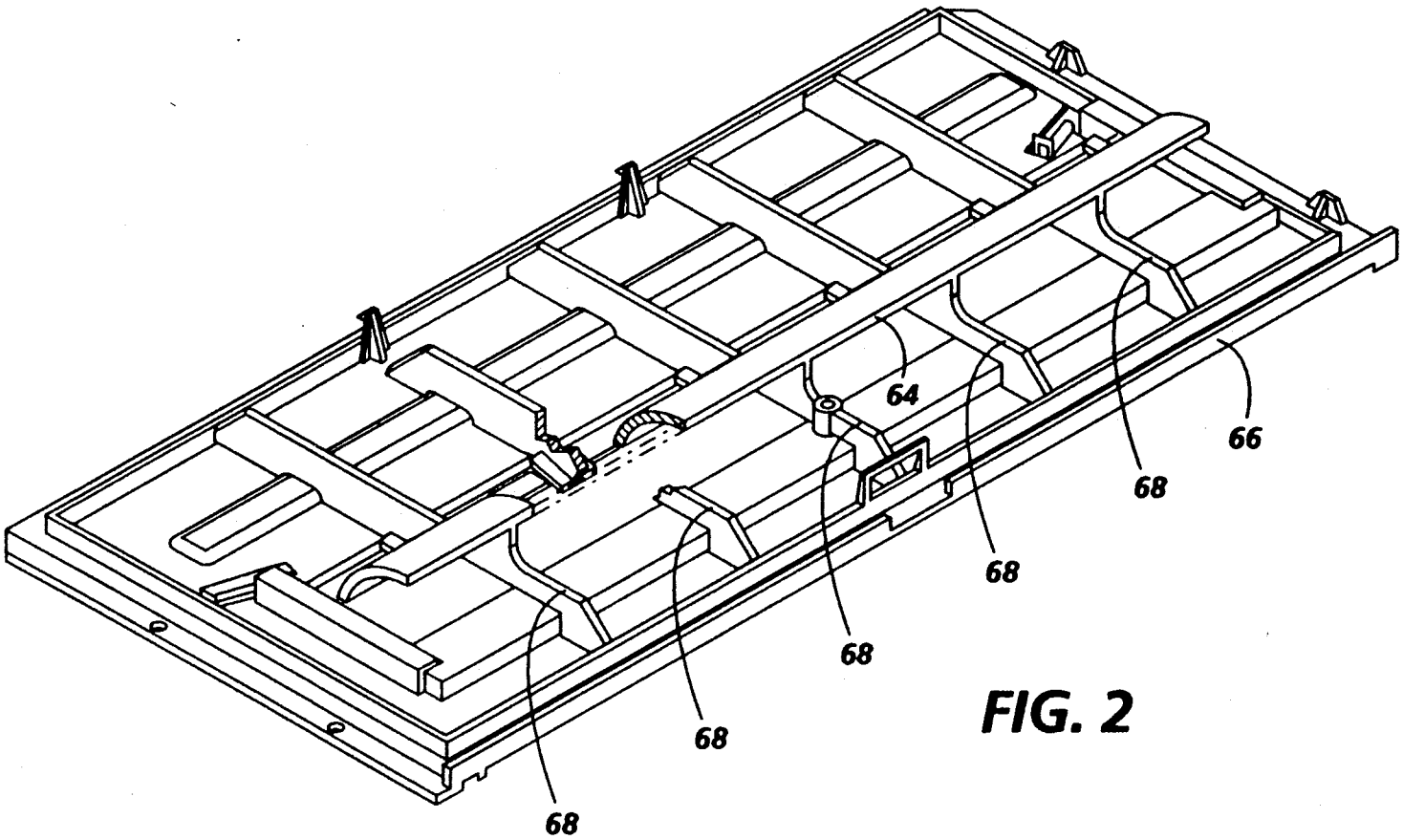
FIG. 2 is an isometric view of the cleaner frame illustrating an integrally molded passive sump fill baffle.

Attention is now directed to FIG. 1, wherein the cleaning station will be described with additional reference to FIG. 2 wherein the photoreceptor belt 14 having a photoconductive insulating surface 15 thereon is transported in the direction of the arrow through the cleaning station. The cleaning station 46 comprises a cleaning platen 49 positioned under the top horizontal run of the imaging belt 14 with a cleaning housing 48 in opposed relationship on the top run of the photoconductive belt 14. Mounted on the cleaner housing is a cleaning blade 47 rigidly held on blade holder 52 which is mounted to blade mount 54 which in turn is a part of the cleaning housing 48. The cleaning blade 47 by virtue of its position and beam deflection is in opposed interference relationship with the top surface of belt 14 supported by cleaning platen 49. Cleaning flap seal 50 is held by seal holder 56 which is a part of the cleaning housing 54 located upstream in the process direction of the cleaning blade. The seal in contact with the photoreceptor 14 insures that toner cleaned from the photoreceptor by the cleaning blade 47 does not escape in the upstream direction from the cleaning housing 48. As the photoreceptor 14 travels in the direction of the arrow, any residual toner remaining thereon is cleaned or scraped from the imaging surface by the blade 47 and transported into the cleaning sump 60. Also illustrated in FIG. 1 are structural members 62 which may be used to optionally provide additional guidance of the photoreceptor belt during transport to the cleaning station. It should be noted that the cleaning blade, cleaning platen, cleaning seal together with the cleaning housing are at least as wide as the imaging area of the photoreceptor belt. In FIG. 1 the cleaning blade 47 is illustrated in a chiseling orientation with regard to the advancing photoreceptor belt. As the belt moves in the direction indicated by the arrow, the tip of the blade 47 chisels any residual toner from the surface of the belt and pushes it up into the cleaner sump 60*a* and 60*b*.

With additional reference to FIG. 2 the passive sump fill baffle 64 according to the present invention will be described in somewhat greater detail. As illustrated in FIG. 2 the passive sump fill baffle may be integrally molded with and mounted to the cleaner frame 66 by means of mounting ribs 68. While best results in terms of separating the cleaned toner into two paths or streams are achieved with a curved baffle it will be understood that the baffle may indeed be straight, at an angle or it may indeed take the shape of a V. By integrally molding the passive baffle with the cleaner frame the function of the passive baffle is achieved at minimal expense as all that is required is the cost of the additional plastic.

Figure 3:
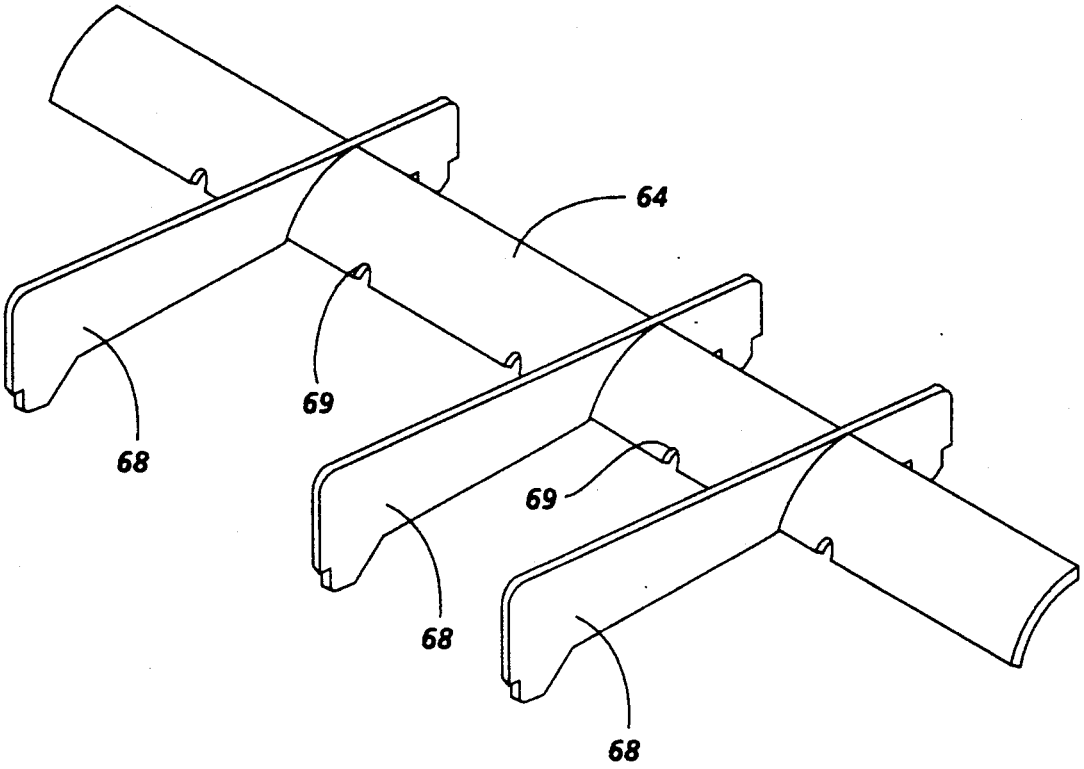
FIG. 3 is an isometric view of a stand alone sump fill baffle.

FIG. 3 illustrates the alternative embodiment wherein the passive baffle 64 is a stand alone molded plastic part which is placed in the sump and has locating features 69 and mounting ribs 68 which space it correctly with respect to the cleaning blade 69.

Turning once again to FIG. 1 the passive sump fill baffle is located in the cleaning housing to divide the residual toner into two parts so that toner flows to both the front and rear portions 60*a* and 60*b* of the cleaner sump. It is important to place the toner directing lead end of the sump fill baffle such that it is not so close to the cleaning blade tip that it inhibits toner movement away from the blade tip nor so far away from the cleaning blade tip that it is ineffective in splitting the toner head. Preferably the toner directing lead end of the sump fill baffle is located above the imaging surface between the cleaning tip of the cleaning blade and the sealing edge of the flap seal. By so locating the lead end of the sump fill baffle the mass of accumulated residual toner is split, the toner head height is limited and the residual cleaned toner is directed to both the front and rear sump portions 60*a* and 60*b* of the cleaner housing.

In operation in the chiseling mode the cleaning blade which is mounted in fixed opposed relationship to the cleaning platen on the opposite side of the imaging surface, uses pressure interference engagement with the photoconductive surface of the belt by means of its beam deflection to provide the force required to clean the imaging surface of toner.

Figure 4A:
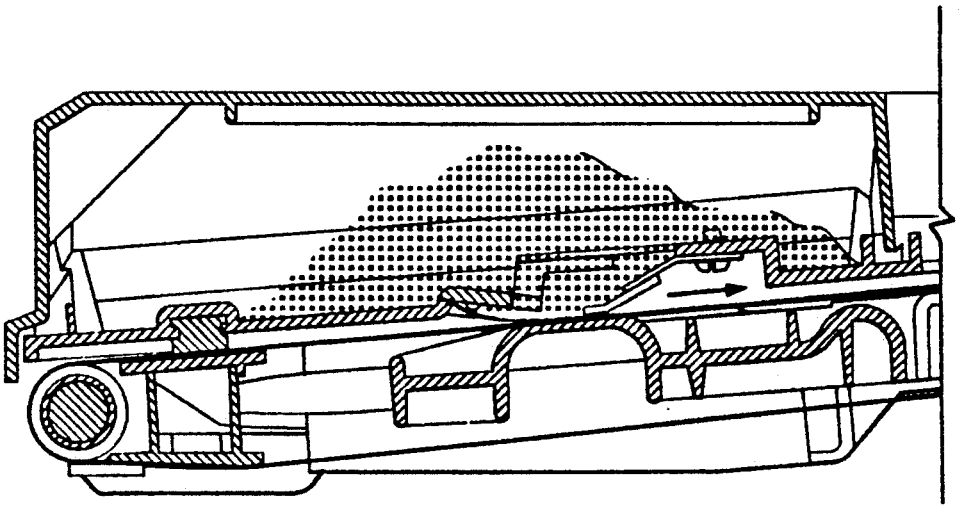
FIG. 4a PRIOR ART
FIGS. 4*a* and 4*b* are cross sectional representations respectively of the amount of cleaned toner in the cleaner sump at cleaning failure without the passive sump fill baffle and with the baffle, according to the present invention.
Figure 4B:
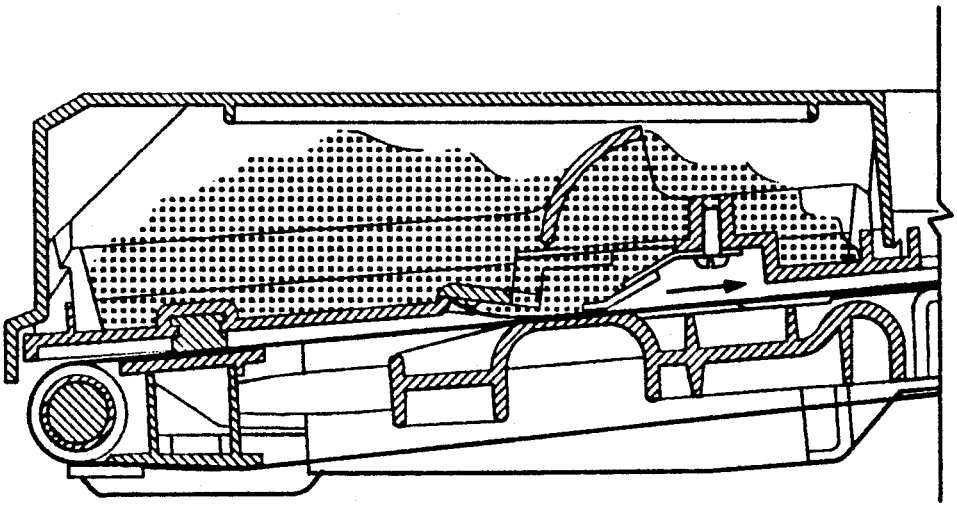

The passive sump fill baffle diverts waste toner being stored by the twelve o'clock blade cleaning system such that the use of available sump space is maximized and the onset of broadband cleaning failure is delayed. FIGS. 4*a* and 4*b* represent the volume level of cleaned toner without the passive sump baffle and with the passive sump baffle collected at the failure point. As may be observed FIG. 4*b* illustrates a better than fifty percent increase in capacity at the failure point. In addition, in view of the orientation of the cleaning blade at roughly the twelve o'clock position, toner material which has been loosened and cleaned from the imaging surface remains in or in close proximity to the cleaning blade and the imaging surface interface continually lubricating the blade at this interface so that the leading edge or tip of the cleaning blade does not tuck under the main body of the cleaning blade thereby causing cleaning failures. The cleaning blade may be made of any suitable material but preferably is made from an elastomer such as urethane. The cleaning seal may be made from a suitable material such as polyurethane, cellulose acetate or Mylar.

Figure 5:
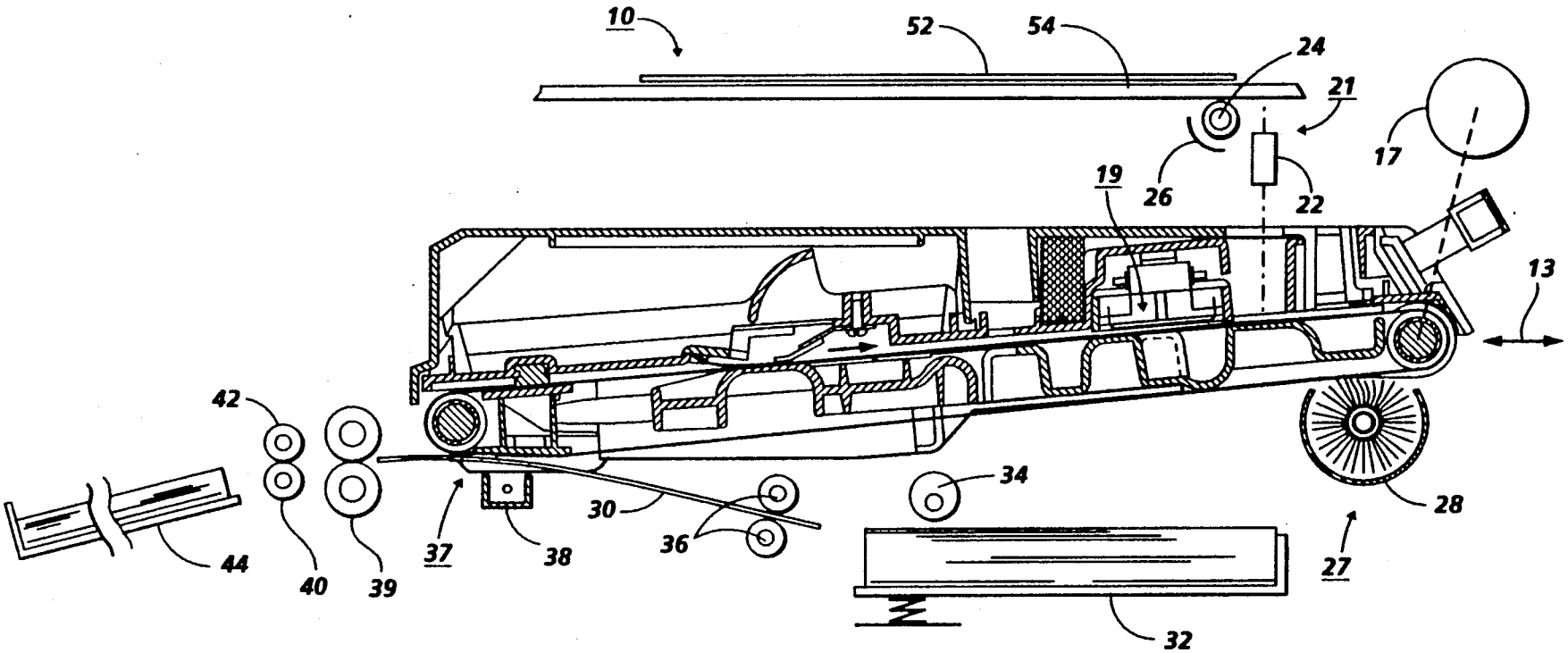
FIG. 5 is a schematic representation in cross section of an automatic electrostatographic printing machine with the blade cleaning apparatus, according to the present invention.

Referring now to FIG. 5, there is shown by way of example an automatic electrostatographic printing machine which includes a removable processing cartridge employing the blade cleaning apparatus, according to the present invention. As illustrated, the removable processing cartridge 12 may be inserted and withdrawn from the main machine frame in the direction of the arrow 13. Briefly, with the processing cartridge inserted into the machine the operation of the machine is controlled by motor 17 to provide direct drive to the photoreceptor belt which is initially charged at charging station 19, exposed to a light and shadow image of a document 52 on a viewing platen 54 at exposure station 21, developed with charged toner material at developer station 27 to develop the electrostatographic latent image with a toner material. The toner is electrostatically transferred to copy paper 30 at transfer station 37 and subsequently fed to the fuser 39 wherein the toner material is fused to the paper, individual sheets of which are collected in the output tray 44. For further details of the above machine, attention is directed to the above referenced U.S. Pat. No. 4,690,544.

Thus, according to the present invention an inexpensive, efficient cleaning system has been provided which maximizes the use of available sump volume in the cleaned or residual toner collecting sump and depending on conditions of temperature and relative humidity can provide an increase of up to 2 to 3 times the life of the processing cartridge prior to failure due to broadband cleaning failure.

The patents and cross referenced application referred to herein above are hereby incorporated by reference in their entirety into the instant application.

While the invention has been described with reference to specific embodiments, it will be apparent to those skilled in the art that many alternatives, modifications and variations may be made. For example, while the invention has been illustrated with an electrostatic latent image formed by the exposure of an electrostatically charged photoconductive member to a light image of an original document, the electrostatic latent image may alternatively be generated from information electronically stored or generated in digital form which may afterward be converted to alpha-numeric images by image generation and electronics and optics. Furthermore, while illustrated with a processing cartridge using a belt imaging surface it will be understood that the present invention has application to a rotary drum type imaging surface as long as the cleaning station is at about the twelve o'clock position. Accordingly, it is intended to embrace all such alternatives and modifications that may fall within the spirit and scope of the appended claims.

We claim:

1. Electrostatographic printing apparatus comprising an endless imaging surface and a blade cleaning station for removing residual toner particles therefrom, said blade cleaning station being positioned on top of said imaging surface at approximately the twelve o'clock position and comprising a cleaner sump housing containing a cleaning blade mounted on said sump to provide front and rear sump portions and in interference with said imaging surface for removing residual toner therefrom, said cleaner sump housing having a passive sump fill baffle mounted thereon to direct residual toner to the front and rear portions of said cleaner sump, said passive sump fill baffle being positioned above said cleaning blade and relative thereto to split a mass of accumulated residual toner, limit the head height of toner accumulated at the cleaning blade/imaging surface interface and direct residual cleaned toner to both the front and rear sump portions.

2. The printing apparatus of claim 1 wherein said passive sump fill baffle is concavely curved in the downstream direction of said imaging surface.

3. The printing apparatus of claim 1 wherein said cleaner housing is molded plastic and said passive sump fill baffle is integrally molded therewith.

4. The printing apparatus of claim 1 wherein said imaging surface comprises an endless flexible belt supported for movement between two support members defining a substantially horizontal top run therebetween and including a rigid stationary cleaning platen under the top run of said belt between said support members for supporting said belt thereon and said cleaning blade is mounted in opposed relationship to said platen.

5. The printing apparatus of claim 1 wherein a flexible flap seal is mounted to said cleaner sump housing upstream of said cleaning blade in the process direction.

6. The printing apparatus of claim 1 wherein said cleaning blade is in chiseling contact with said imaging surface for removing toner therefrom.

7. The printing apparatus of claim 5 wherein said sump fill baffle has a toner directing lead end which is located above the imaging surface between the cleaning tip of said cleaning blade and the sealing edge of said flap seal.

8. The printing apparatus of claim 2 wherein said cleaner housing is molded plastic and said passive sump fill baffle is integrally molded therewith.

9. The printing apparatus of claim 2 wherein said imaging surface comprises an endless flexible belt supported for movement between two support members defining a substantially horizontal top run therebetween and including a rigid stationary cleaning platen under the top run of said belt between said support members for supporting said belt thereon and said cleaning blade is mounted in opposed relationship to said platen.

10. The printing apparatus of claim 2 wherein a flexible flap seal is mounted to said cleaner sump housing upstream of said cleaning blade in the process direction.

11. The printing apparatus of claim 2 wherein said cleaning blade is in chiseling contact with said imaging surface for removing toner therefrom.

12. The printing apparatus of claim 2 wherein said sump fill baffle has a toner directing lead end which is located above the imaging surface between the cleaning tip of said cleaning blade and the sealing edge of said flap seal.

13. The printing apparatus of claim 4 wherein a flexible flap seal is mounted to said cleaner sump housing upstream of said cleaning blade in the process direction.

14. The printing apparatus of claim 4 wherein said cleaning blade is in chiseling contact with said imaging surface for removing toner therefrom.

15. The printing apparatus of claim 4 wherein said sump fill baffle has a toner directing lead end which is located above the imaging surface between the cleaning tip of said cleaning blade and the sealing edge of said flap seal.

* * * * *